United States Patent [19]

Tinfow

[11] Patent Number: 4,565,033

[45] Date of Patent: Jan. 21, 1986

[54] THRESHOLD HAVING A VERTICALLY ADJUSTABLE FLEXIBLE WEATHERSTRIP

[76] Inventor: Lionel Tinfow, 24 Oak Pl., North Caldwell, N.J. 07006

[21] Appl. No.: 608,352

[22] Filed: May 9, 1984

[51] Int. Cl.[4] ..... E06B 1/70

[52] U.S. Cl. ..... 49/468; 49/469; 52/718.1

[58] Field of Search ..... 49/467, 468, 469; 52/718

[56] References Cited

U.S. PATENT DOCUMENTS

| | | | |
|---|---|---|---|
| 1,178,859 | 4/1916 | Krause | 49/468 |
| 2,839,796 | 6/1958 | Quoss | 49/468 |
| 4,003,162 | 1/1977 | Britt | 49/468 |
| 4,146,995 | 4/1979 | Britt | 49/468 |
| 4,224,766 | 9/1980 | Procton | 49/468 |

*Primary Examiner*—Donald G. Kelly
*Assistant Examiner*—Creighton Smith
*Attorney, Agent, or Firm*—John N. Bain

[57] ABSTRACT

A threshold having a vertically adjustable weatherstrip including a unitary base member and a horizontally slidable adjustment means in which the height of the flexible weatherstrip may be controlled to engage the bottom of a door.

1 Claim, 1 Drawing Figure

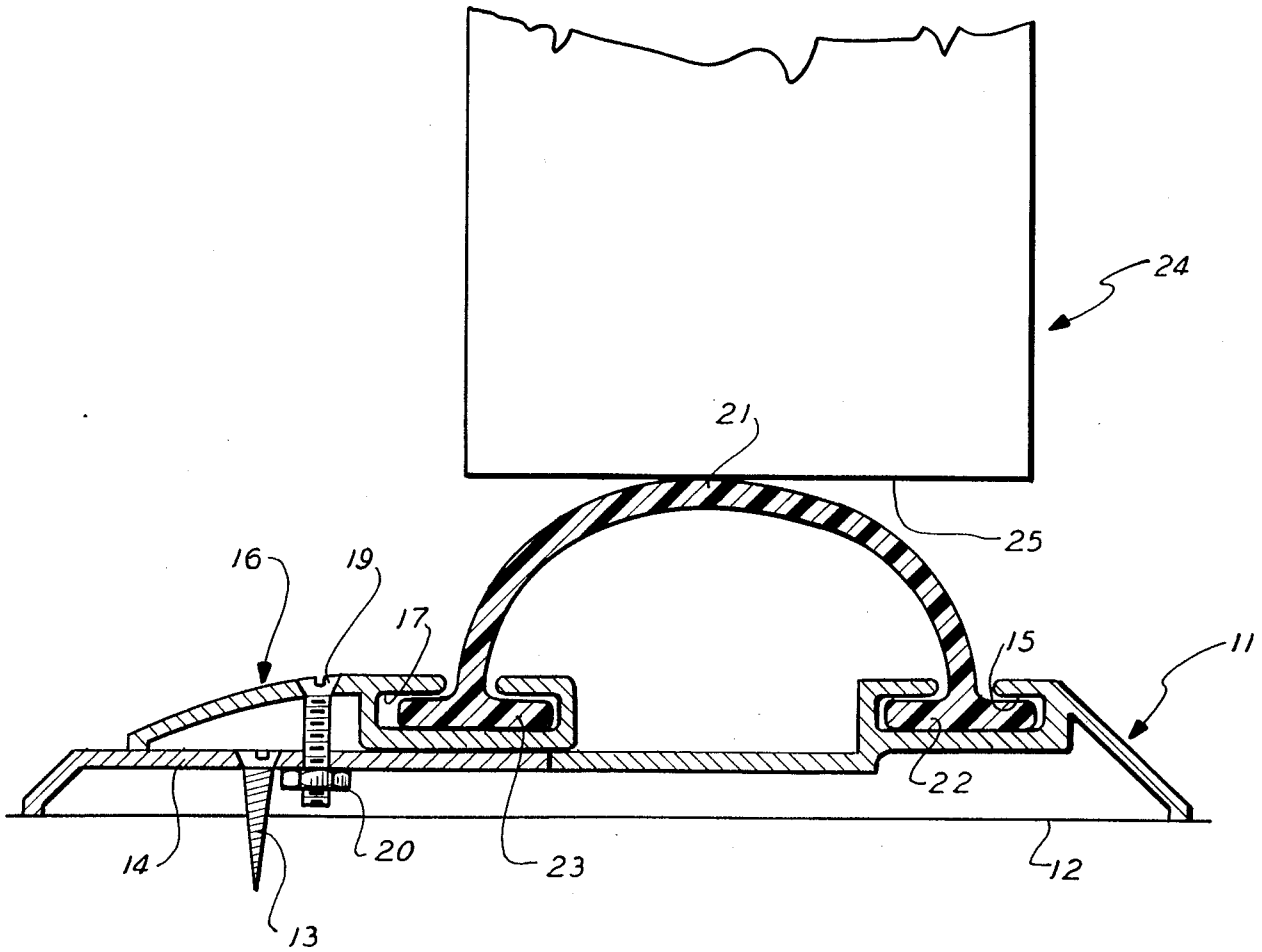
24
11
25
12
15
22
21
23
17
20
19
13
16
14

THRESHOLD HAVING A VERTICALLY ADJUSTABLE FLEXIBLE WEATHERSTRIP

BACKGROUND OF INVENTION

A wide variety of weatherstrip thresholds are known in the prior art. The weatherstripping, usually some sort of vinyl insert, must make precise contact with the bottom of the door to be effective. If the distance between the bottom of the door and the insert is too small, the insert will fold upon itself and either prevent the door from closing or be destroyed. On the other hand, if the distance between the bottom of the door and the insert is too great, air will pass through the gap and the weatherstrip effect will be lost.

A common solution is to trim the bottom of the door precisely, which requires a considerable degree of skill not commonly possessed by the ordinary homeowner. Consequently, a variety of designs have been proposed to permit those unskilled to make appropriate adjustments. For instance, in some prior designs, the entire threshold or a portion thereof is raised until the weatherstrip insert engages the bottom of the door to the desired degree. However, the raised portion of the weatherstrip presents a tripping hazard.

In another prior art design, characterized by U.S. Pat. No. 3,083,420, the vinyl is self-adjusting but the vertical adjustment is limited to approximately one-quarter inch. Moreover, after approximately six months to a year, the common vinyl insert takes a shape memory "set" to the bottom of the door. Should the distance between the door and the threshold vary due to settling, wood shrinkage or the like, either the weatherseal contact will be lost or the insert ripped due to lack of clearance.

In the present invention, tripping hazards due to raising the threshold or a portion thereof is eliminated. Moreover, vertical adjustment of the vinyl insert is as great as three-eights of an inch for a normal three and one-half inch wide threshold and greater in thresholds which are wider.

Another object of the present invention is to provide means for adjusting the height of the vinyl insert with the door in the closed position, thereby eliminating the trial and error procedures necessary for achieving proper contact between the vinyl insert and the bottom of the door in existing thresholds wherein there is no access to vertical adjustment screws or other means unless the door is in the open position. As a consequence, installation in the present design is faster and more precise.

In the present invention, a well known generally inverted U-shaped flexible vinyl insert is employed having a bead or tongue engageable in a groove which may be extruded into an aluminum threshold resembling those in use today. However, while one of the edges of the vinyl insert is engaged in a tongue and groove relationship in the threshold, the other is engaged in a similar tongue and groove relationship to an adjustment plate or bar which is moveably and adjustably mounted to the top of the threshold. By moving the plate or bar toward or away from the opposite edge of the vinyl insert, fixedly secured to the top of the threshold, the height of the vinyl insert can be adjusted upwardly or downwardly to precisely engage the bottom of the door. The means for loosening the bar or plate from the threshold so that it may be slid toward or away from the opposite edge of the vinyl insert is located in a plane outside of the vertical plane of the face of the door so that it may be loosened and tightened with the door in a closed position.

SUMMARY OF INVENTION

A threshold having a vertically adjustable, flexible weatherstrip comprising:

(a) a threshold mountable to a surface beneath a door;

(b) a flexible weatherstrip secured to the threshold engageable with the bottom of the door when closed;

(c) the weatherstrip having a generally inverted arcuate configuration and defining a pair of edges one of which is attachable to the threshold and the other of which is attachable to weatherstrip adjustment means;

(d) weatherstrip adjustment means mounted to the threshold for movement in the direction of the edge of the weatherstrip attached to the threshold; and (e) retaining means for fixedly positioning the weatherstrip adjustment means with respect to the threshold.

PREFERRED EMBODIMENT OF THE INVENTION

A preferred embodiment of my invention is illustrated in the drawings in which FIG. 1 is a side elevational cross-sectional view of a threshold embodying my invention.

Referring now to the drawings in detail, a preferred embodiment of my invention includes an extruded aluminum threshold 11 which is secured to the floor 12 by means of screws 13 which extend through appropriate openings in the top surface 14 of the threshold 11.

Along one edge of the threshold 11 a groove 15 is extruded. Along the opposite side of the threshold 11 a weatherstrip adjustment bar 16 is moveably and adjustably mounted. The bar 16 is provided with an extruded groove 17 which is complementary to the extruded groove 15 in the threshold 11. The top 14 of the threshold 11 is provided with slots 18 to receive a bolt 19 which extends downwardly through the adjustment bar 16 and through the slot 18. A nut 20 engaged to the bolt 19 provides retaining means for the adjustment bar 16. The number of slots 18 provided is a matter of choice.

A flexible vinyl insert 21 having feet 22 and 23 is mounted on top of the threshold 11 and is engageable with the bottom of a door 24.

The feet, 22 and 23 on the vinyl insert 21 slide into the grooves 15 and 17, respectively.

In operation, the threshold 11 is positioned beneath the plane of the door when closed with the leading edge of the vinyl insert 21 engaged in the groove 15. Screws 13 are then engaged into the floor 12 to secure the threshold 11 in place.

With the door 24 in the closed position, and the bolt 19 loosened on the nut 20, the adjustment bar 16 is moved either toward or away from the leading edge of the vinyl insert so as to either increase or decrease the vertical height of the insert 21 until it just engages the bottom 25 of the door 24. The bolt 19 is then tightened to secure the adjustment bar 16 in position. It should be noted that the bolt 19 is accessable when the door 24 is closed.

Modifications and variations of the above-disclosed invention are possible in light of the above teaching, and accordingly, within the scope of the appended claims, the invention may be practiced otherwise than as particularly described.

I claim:

1. A threshold having a vertically adjustable, flexible weatherstrip comprising:

(a) a unitary base member having an upper surface, spaced apart first and second edges engagable to a supporting surface beneath a door and a pair of spaced apart ends, (b) the base member having an uninterrupted, upwardly opening channel formed integrally on its upper surface extending from end to end thereof, and generally adjacent to and parallel with one of the edges, the channel being upwardly open uninterruptedly from end to end of the base member, the said opening being dimensioned more narrow than the channel in a direction normal to the said edges;

(c) unitary weatherstrip adjustment means adjustably movably mounted on the upper surface of and extending uninterruptedly from end to end of the base member and positioned generally adjacent to the edge thereof opposite the first said channel, the said adjustment means having both an upper surface and an edge engagable to the upper surface of the base member, (d) the weatherstrip adjustment means having an uninterrupted, upwardly opening channel formed integrally on the upper surface thereof generally opposite to and extending from end to end thereof and parallel with the said edge thereof, the upward opening to the channel on the weatherstrip adjustment means extending uninterruptedly along the entire length of the edge, being open at both ends and dimensioned more narrow than its communicating channel in a direction normal to the edge of the adjustment means, (e) a flexible generally upwardly convex weatherstrip detachably mounted to the base member and the adjustment means having a first edge with a crossectional configuration conforming to the crossectional configuration of the channel on the upper surface of the base member and a second edge with a crossectional configuration conforming to the crossectional configuration of the channel on the upper surface of the adjustable means, (f) the first and second edges on the weatherstrip being slidably mounted in the channel on the base member and the channel on the adjustment means respectively, the weatherstrip extending through the upward openings of each said channel uninterruptedly from end to end of the threshold, (g) retaining means extending between the base member and the adjustment means, the adjustment means being movable in a direction toward and from the channel formed on the base means and being fixedly positionable by the retaining means at a range of distances from said channel sufficient to alter upwardly and downwardly the apex of the upwardly convex weatherstrip.

* * * * *